US008229316B2

(12) United States Patent
Park

(10) Patent No.: US 8,229,316 B2
(45) Date of Patent: Jul. 24, 2012

(54) IMAGE FORMING APPARATUS AND BELT CLEANING UNIT THEREOF

(75) Inventor: Moon-bae Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1230 days.

(21) Appl. No.: 11/942,128

(22) Filed: Nov. 19, 2007

(65) Prior Publication Data

US 2008/0199209 A1 Aug. 21, 2008

(30) Foreign Application Priority Data

Feb. 20, 2007 (KR) ..... 10-2007-0017144

(51) Int. Cl.
*G03G 15/16* (2006.01)

(52) U.S. Cl. ..... 399/101; 399/343; 399/345; 198/499; 198/814

(58) Field of Classification Search ..... 399/101, 399/343, 345; 198/499, 814
See application file for complete search history.

(56) References Cited

U.S. PATENT DOCUMENTS

| | | | | |
|---|---|---|---|---|
| 4,702,591 | A * | 10/1987 | Tsuda et al. | 399/345 |
| 4,795,024 | A * | 1/1989 | Eatwell | 198/499 |
| 5,258,816 | A * | 11/1993 | Haneda et al. | 399/165 |
| 5,797,078 | A * | 8/1998 | Sass et al. | 399/357 |
| 5,970,297 | A * | 10/1999 | Gross | 399/313 |
| 5,983,050 | A * | 11/1999 | Takekoshi et al. | 399/71 |
| 6,704,528 | B1 * | 3/2004 | Kawamura et al. | 399/123 |
| 6,785,500 | B2 * | 8/2004 | Takahashi et al. | 399/297 |
| 6,795,667 | B2 * | 9/2004 | Nakazawa et al. | 399/111 |
| 6,865,361 | B2 * | 3/2005 | Abe et al. | 399/302 |
| 6,907,217 | B2 * | 6/2005 | Hattori | 399/297 |
| 7,209,694 | B2 * | 4/2007 | Fujita et al. | 399/302 |
| 7,609,992 | B2 * | 10/2009 | Kim | 399/101 |
| 2005/0078991 | A1 * | 4/2005 | Kimura et al. | 399/350 |
| 2005/0081889 | A1 * | 4/2005 | Nakano et al. | 134/6 |
| 2006/0108201 | A1 * | 5/2006 | Swinderman | 198/499 |
| 2006/0216057 | A1 * | 9/2006 | Fukao | 399/101 |
| 2006/0251444 | A1 * | 11/2006 | Ozawa et al. | 399/101 |

(Continued)

FOREIGN PATENT DOCUMENTS

JP 3-168678 7/1991

(Continued)

OTHER PUBLICATIONS

Chinese Office Action issued Apr. 14, 2011 in CN Application No. 200810007255.5.

(Continued)

*Primary Examiner* — David Gray
*Assistant Examiner* — Geoffrey Evans
(74) *Attorney, Agent, or Firm* — Stanzione & Kim, LLP

(57) ABSTRACT

An image forming apparatus includes a first belt roller which has a first roller shaft, a second belt roller which is disposed parallel with the first roller shaft and slidingly approaches and departs from the first roller shaft, and has a second roller shaft, a belt which is driven in circulation by the first belt roller and the second belt roller, an elastic tension member which elastically pushes the second belt roller to be separated from the first belt roller and a belt cleaning unit which is supported by the second roller shaft and is movable between a cleaning position contacting a surface of the belt and a stand-by position departed from the surface of the belt.

23 Claims, 15 Drawing Sheets

U.S. PATENT DOCUMENTS

| | | | | |
|---|---|---|---|---|
| 2007/0003316 | A1* | 1/2007 | Fujiwara | 399/101 |
| 2007/0003317 | A1* | 1/2007 | Masuda | 399/101 |
| 2007/0110471 | A1* | 5/2007 | Kitamura | 399/101 |
| 2007/0189802 | A1* | 8/2007 | Maeda et al. | 399/101 |
| 2007/0196125 | A1* | 8/2007 | Koizumi et al. | 399/101 |
| 2009/0185818 | A1* | 7/2009 | Saka | 399/101 |
| 2010/0014878 | A1* | 1/2010 | Tomita | 399/49 |

FOREIGN PATENT DOCUMENTS

| | | |
|---|---|---|
| JP | 5-224563 | 9/1993 |
| JP | 2006317594 | 11/2006 |
| KR | 88-13025 | 8/1988 |
| KR | 1998-13372 | 6/1998 |
| KR | 1998-67298 | 12/1998 |

OTHER PUBLICATIONS

Korean Office Action issued Apr. 18, 2011 in KR Application No. 10-2007-0017144.

Chinese Office Action issued Oct. 17, 2011 in CN Application No. 200810007255.5.

* cited by examiner

IMAGE FORMING APPARATUS AND BELT CLEANING UNIT THEREOF

CROSS-REFERENCE TO RELATED APPLICATIONS

This application claims priority under 35 U.S.C §119(a) from Korean Patent Application No. 10-2007-0017144, filed on Feb. 20, 2007 in the Korean Intellectual Property Office, the disclosure of which is incorporated herein in its entirety by reference.

BACKGROUND OF THE INVENTION

1. Field of the Invention

Apparatuses and methods consistent with the present general inventive concept relate an image forming apparatus and a belt cleaning unit thereof, and more particularly to an image forming apparatus whose cleaning structure is improved.

2. Description of the Related Art

An electrophotographic type image forming apparatus performs a series of processes including charging, exposing, developing, transferring and fusing to form image on a printing medium, and includes a multi-function printer, a laser printer and others known in the art.

As illustrated in FIGS. 1 and 2, such a conventional electrostatic type image forming apparatus has a photosensitive drum 3 and a transfer belt 11 rotated in a track.

In FIG. 1, the transfer belt 11 is rotated in a track by two rollers, that is, a driving roller 13 and a driven roller 15. In FIG. 2, the transfer belt 11*a* is rotated in a track by three rollers, that is, a driving roller 13*a*, a driven roller 15*a* and an auxiliary driven roller 12. As the transfer belt 11 may be elongated or contracted according to environmental condition such as temperature and humidity, the types of the transfer belt illustrated in FIGS. 1 and 2 are used so that the transfer belt 11 can have its tension of a predetermined range irrespective of the environmental condition. According to the type of the transfer belt illustrated in FIG. 1, an elastic force is applied to the driven roller 15 to be separated from the driving roller 13 in a direction N which is parallel to a line (hereinafter, referred to as a 'center line') A connecting rotation centers of the driven roller 15 and the driving roller 13.

Alternatively, according to the type of the transfer belt illustrated in FIG. 2, the elastic force is applied to an additional auxiliary driven roller 12 in a direction P with respect to the center line A in a state of fixing the rotation centers of the driven roller 15*a* and the driving roller 13*a* constant, thus maintaining tension of the transfer belt 11.

Also, as illustrated in FIGS. 1 and 2, the conventional image forming apparatus 10(10*a*) has a belt cleaning unit 16(16*a*) to remove waste developer remaining on the transfer belt 11(11*a*). In this case, the belt cleaning unit 16(16*a*) has a blade 18(18*a*) and a blade supporting member 17(17*a*). The blade 18(18*a*) is made of elastic material and contacts the transfer belt 11(11*a*) to scrape off the waste developer from the belt 11(11*a*). Also, the blade supporting member 17(17*a*) is rotated around a fixed hinge point 19(19*a*) and supports the blade 18(18*a*).

However, according to the conventional image forming apparatus 10, as illustrated in FIG. 1, the driven roller 15 slides to approach or depart from the driving roller 13 to maintain the tension of the transfer belt 11, while the position of the blade 18 is fixed by the hinge point 19, thus changing a contact point of the belt 11(11*a*) that contacts the blade 18 with the transfer belt 11. Accordingly, a contact pressure between the blade 18 and the transfer belt 11 is changed, which can generate poor cleaning and cause damage on the blade 18 and the transfer belt 11 if an excessive contact pressure is applied.

Also, according to the second image forming apparatus 10*a*, as illustrated in FIG. 2, the contact point between the blade 18*a* and the transfer belt 11*a* can be maintained to be stationary. However, as the auxiliary driven roller 12 moves up and down toward the direction P, the transfer belt 11*a* may slip or move obliquely. Also, an addition of the auxiliary driven roller 12 causes an increase in the cost and a decrease in space efficiency.

Also, as illustrated in FIGS. 1 and 2, even if cleaning of the waste developer is not required, the blade 18(18*a*) is always in contact with the transfer belt 11(11*a*). Accordingly, the blade 18(18*a*) or the transfer belt 11(11*a*) is worn rapidly and thus decreasing durability.

SUMMARY OF THE INVENTION

The present general inventive concept provides an image forming apparatus and belt cleaning unit thereof that can decrease a malfunction in cleaning.

The present general inventive concept provides the image forming apparatus and belt cleaning unit thereof by which durability is increased.

Additional aspects and utilities of the present general inventive concept will be set forth in part in the description which follows and, in part, will be obvious from the description, or may be learned by practice of the present general inventive concept.

The foregoing and/or other aspects and utilities of the present general inventive concept can be achieved by providing an image forming apparatus including a first belt roller which has a first roller shaft, a second belt roller which is disposed parallel with the first roller shaft and slidingly approaches and departs from the first roller shaft, and has a second roller shaft, a belt which is driven in circulation by the first belt roller and the second belt roller, an elastic tension member which elastically pushes the second belt roller to be separated from the first belt roller, and a belt cleaning unit which is supported by the second roller shaft and is movable between a cleaning position contacting a surface of the belt and a stand-by position departed from the surface of the belt.

The belt cleaning unit may include a blade which is enabled to contact the surface of the belt, a blade supporting member which supports the blade, and a slide member which rotatably supports the blade supporting member about a blade rotating axis being parallel with the second roller shaft and is able to slide along with the second roller shaft.

The belt cleaning unit may further include a blade elastic member which applies elastic force to the blade supporting member to be rotated to the cleaning position, and a stopper which is provided at the cleaning position and regulates a rotating position of the blade supporting member.

The blade elastic member may connect the slide member with the blade supporting member.

The image forming apparatus including the blade elastic member and the stopper may further include a cleaning driving unit that selectively moves the blade to the cleaning position and the stand-by position.

The image forming apparatus may further include a controller that controls the cleaning driving unit for the blade to be located at the stand-by position if the belt doesn't need cleaning.

The stopper may be provided integrally with the slide member.

The blade elastic member may connect the slide member with the blade supporting member, wherein the stopper is provided integrally with the slide member.

The image forming apparatus may further include a cleaning driving unit that selectively moves the blade to the cleaning position and the stand-by position.

The cleaning driving unit may include a lever that rotates in connection with the blade supporting member, a cam which applies or releases pressure on the lever so that the blade can move to the stand-by position or to the cleaning position, and a cam driving unit which drives the cam to rotate.

The image forming apparatus may further include a controller that determines whether the belt needs cleaning and controls the cam driving unit on a basis of result of the determination.

The image forming apparatus may further include a cleaning housing that accommodates the blade and the blade supporting member and rotatably supports the lever, and a housing supporting frame which stationarily supports the cleaning housing.

The image forming apparatus may further include a photosensitive body which is developed with developer so that a developer visualized image corresponding to image information can be formed, and a transfer roller which is disposed parallel with the photosensitive member by having the belt therebetween.

The foregoing and/or other aspects and utilities of the present general inventive concept can also be achieved by providing a belt cleaning unit to remove developer remaining on a surface of a belt in an image forming apparatus, including a first belt roller which has a first roller shaft, a second belt roller which is disposed parallel with the first roller shaft and slidingly approaches and departs form the first roller shaft and has a second roller shaft, the belt which is driven in circulation by the first belt roller and the second belt roller, an elastic tension member which elastically pushes the second belt roller to be separated from the first belt roller and a blade which is supported by the second roller shaft and is movable between a cleaning position contacting with the surface of the belt and a stand-by position departing from the surface of the belt.

The belt cleaning unit may further include a blade supporting member which supports the blade, and a slide member which rotatably supports the blade supporting member about a blade rotating axis being parallel with the second roller shaft and is able to slide along with the second roller shaft.

The belt cleaning unit may further include a blade elastic member which applies elastic force to the blade supporting member to be rotated to the cleaning position, and a stopper which is provided at the cleaning position and regulates a rotating position of the blade supporting member.

The belt cleaning unit may further include a lever which rotates in connection with the blade supporting member, a cam which applies or releases pressure on the lever so that the blade can move to the stand-by position or to the cleaning position, and a cam driving unit which drives the cam to rotate.

The belt cleaning unit may further include a controller which controls the cam driving unit for the cam to release pressure from the lever if the belt doesn't need cleaning.

The foregoing and/or other aspects and utilities of the present general inventive concept may be achieved by providing an image forming apparatus, including a belt to receive developer, a roller disposed proximate to the belt to move in a tension-adjusting direction to change an amount of tension of the belt, a belt cleaning unit to contact the belt at a contact area to remove unused developer from the belt and to move corresponding to the movement of the roller to substantially remain in contact with the belt at the contact area.

The foregoing and/or other aspects and utilities of the present general inventive concept may be achieved by providing an image forming apparatus, including a belt to receive developer, a roller disposed proximate to the belt to move in a tension-adjusting direction to change an amount of tension of the belt and a belt cleaning unit supported by the roller to move between a cleaning position contacting a surface of the belt to remove unused developer from the belt and a stand-by position not in contact with the surface of the belt.

The foregoing and/or other aspects and utilities of the present general inventive concept may be achieved by providing a method of operating an image forming apparatus, the method including receiving developer on a belt, moving a roller in a tension-adjusting direction to change an amount of tension of the belt, contacting the belt by a belt cleaning unit at a contact area to remove unused developer from the belt and moving the belt cleaning unit corresponding to the movement of the roller to substantially remain in contact with the belt at the contact area.

The foregoing and/or other aspects and utilities of the present general inventive concept may be achieved by providing a computer-readable recording medium having embodied thereon a computer program to execute a method, wherein the method includes receiving developer on a belt, moving a roller in a tension-adjusting direction to change an amount of tension of the belt, contacting the belt by a belt cleaning unit at a contact area to remove unused developer from the belt and moving the belt cleaning unit corresponding to the movement of the roller to substantially remain in contact with the belt at the contact area.

BRIEF DESCRIPTION OF THE DRAWINGS

The above and/or other aspects and utilities of the present general inventive concept will become apparent and more readily appreciated from the following description of the exemplary embodiments, taken in conjunction with the accompanying drawings, in which.

DETAILED DESCRIPTION OF THE PREFERRED EMBODIMENTS

Figure 1:
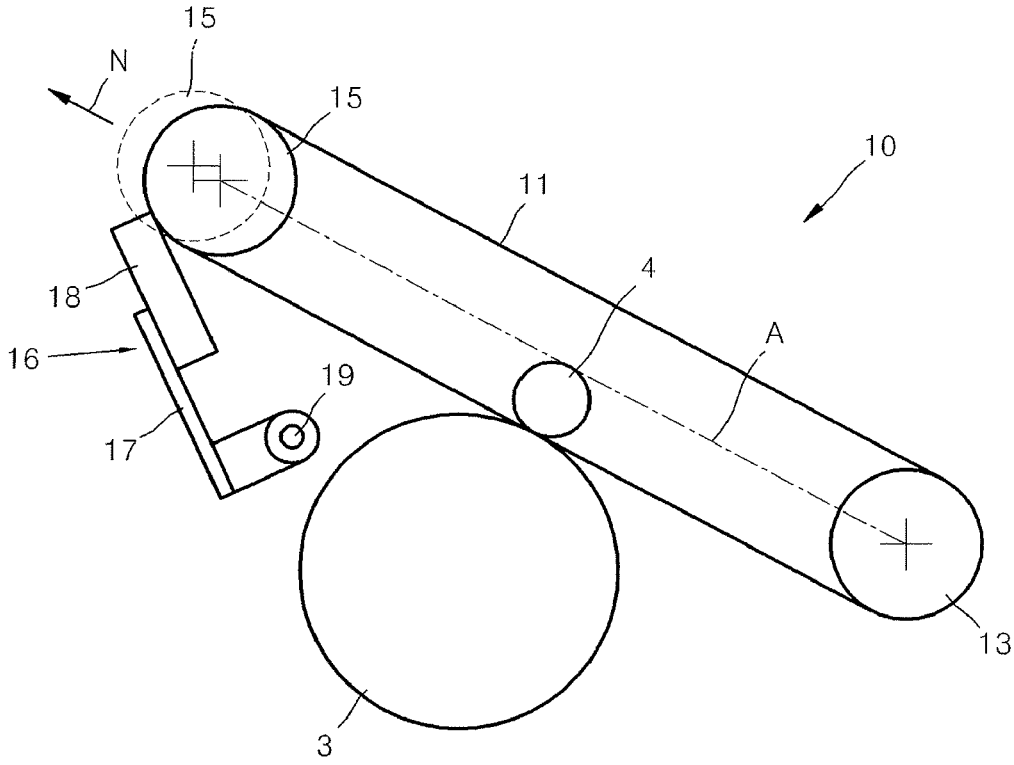
FIG. 1 is a schematic sectional view illustrating a portion of a conventional image forming apparatus.
Figure 2:
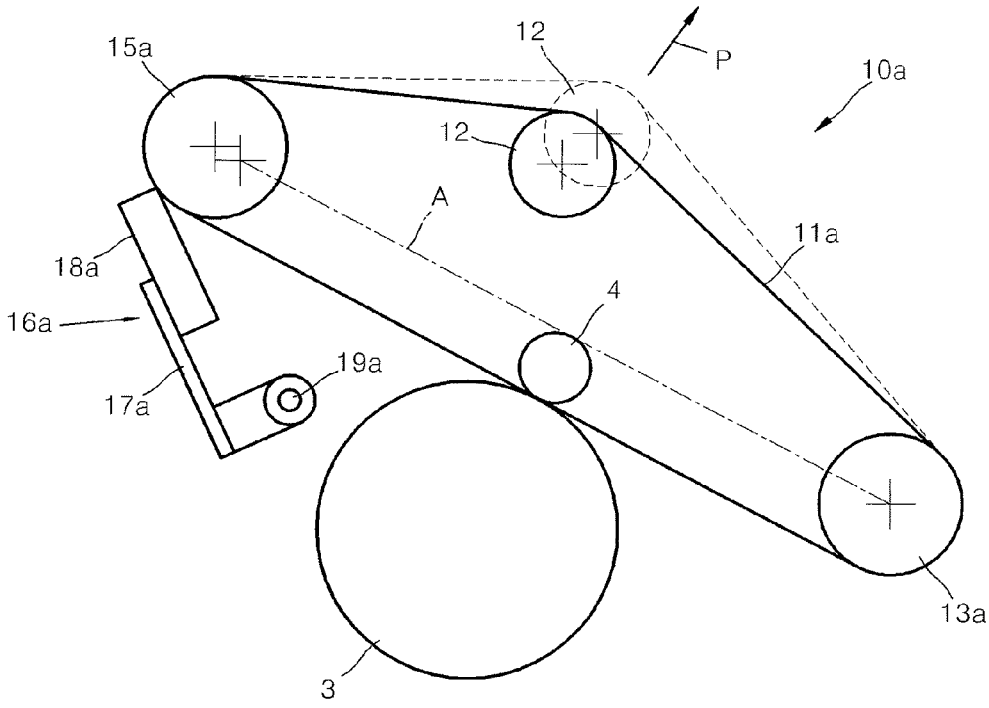
FIG. 2 is a schematic sectional view illustrating a portion of another conventional image forming apparatus.

Reference will now be made in detail to embodiments of the present general inventive concept, examples of which are illustrated in the accompanying drawings, wherein like reference numerals refer to like elements throughout. The embodiments are described below so as to explain the present general inventive concept by referring to the figures.

An image forming apparatus according to the present general inventive concept has an exposing unit (not illustrated), a developing cartridge (not illustrated), a photosensitive member (not illustrated) and a transfer belt unit (. The exposing unit (not illustrated) exposes surface of the photosensitive member (not illustrated) with light corresponding to image information and generates a potential difference on the surface of the photosensitive member to form electrostatic latent image.

The developing cartridge (not illustrated), which contacts surface of the photosensitive member (not illustrated), has a developing roller (not illustrated) disposed parallel with the photosensitive member (not illustrated), a supplying roller (not illustrated) and a developer storing unit (not illustrated). Developer stored in the developer storing unit (not illustrated) is conveyed through the supplying roller (not illustrated) and the developing roller (not illustrated), and applied onto the electrostatic latent image thus forming developer visualized image including the developer on the surface of the photosensitive member (not illustrated).

Figure 3:
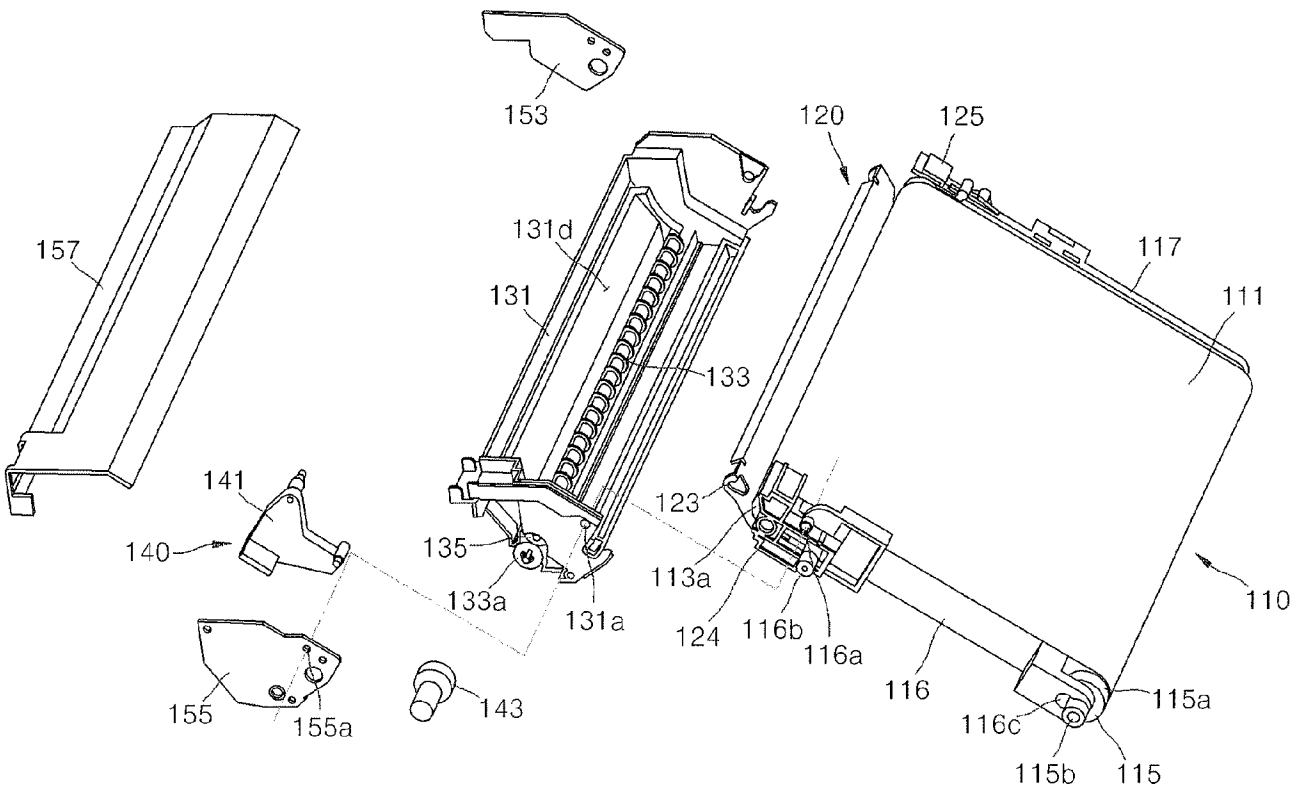
FIG. 3 is an exploded schematic view illustrating a portion of an image forming apparatus according to an embodiment to the present general inventive concept.

Referring to FIG. 3, a transfer belt 111 is provided between the photosensitive member (not illustrated) and the transfer roller (not illustrated) disposed parallel with the photosensitive member. The developer visualized image on the photosensitive member is transferred onto the transfer belt 111 by the transfer roller (not illustrated). Then, the developer visualized image on the surface of the transfer belt 111 is transferred onto a printing medium and passes through a fusing unit (not illustrated) to be fused by heat and pressure, thus completes printing.

As illustrated in FIG. 3, the transfer belt unit according to an exemplary embodiment of the present general inventive concept includes a belt assembly 110, a belt cleaning unit 120, a cleaning housing 131 and a cleaning driving unit 140. Reference numerals 153 and 155 are side brackets, which are disposed both lateral sides of the cleaning housing 131. The left side bracket 155 performs function of preventing a lever 141 of the cleaning driving unit 140 to be described later from being separated apart therefrom.

Figure 7:
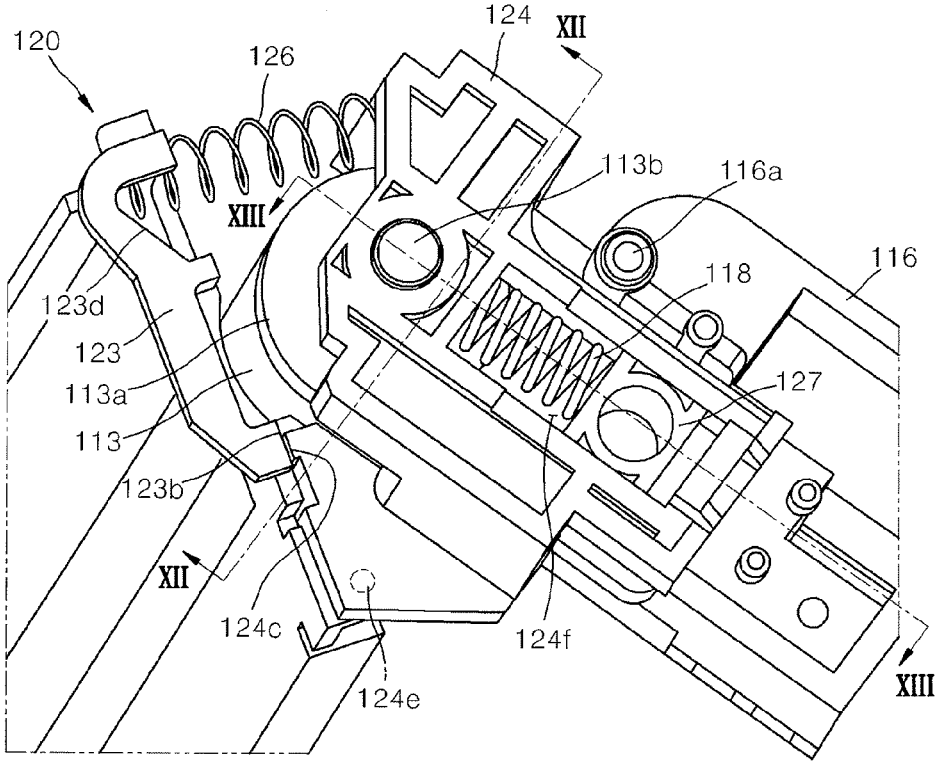
FIG. 7 is a lateral perspective view illustrating the portion of the image forming apparatus in FIG. 3.

FIG. 7 is a lateral perspective view of the belt assembly 110 and the belt cleaning unit 120. For simplicity, a position determining protrusion (116*b* in FIG. 13) of a side frame 116 is omitted.

Figure 8:
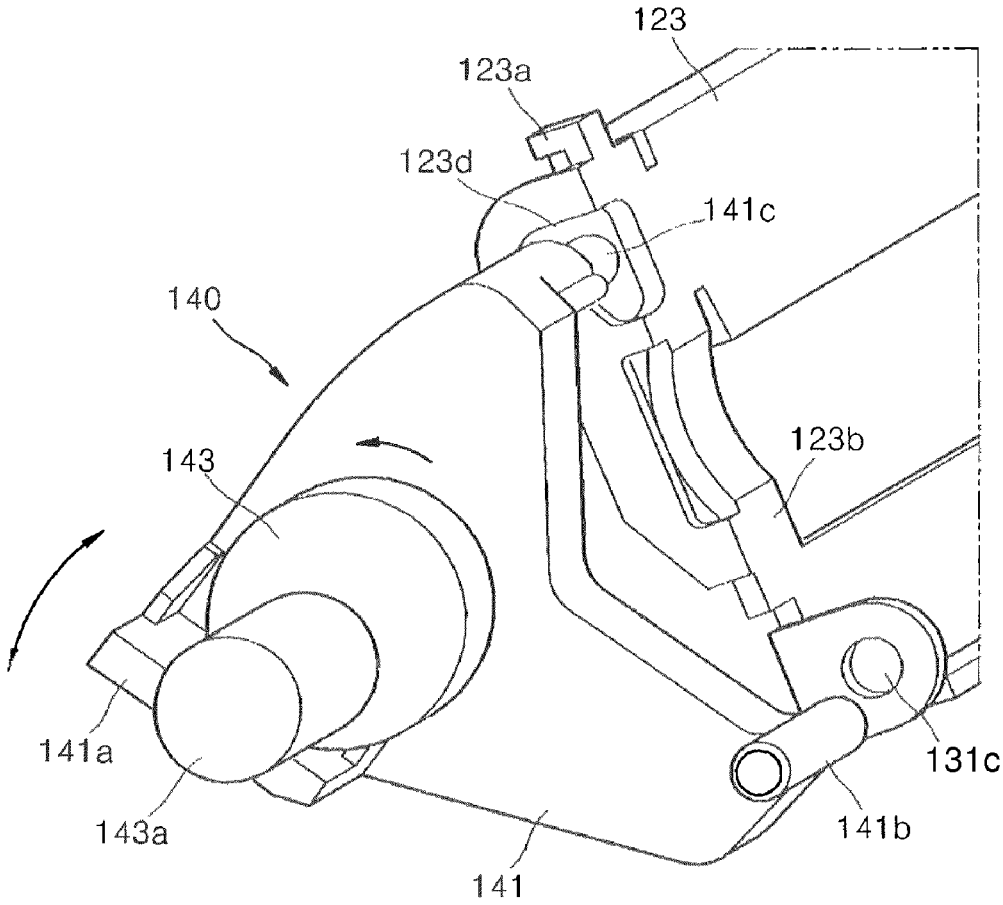
FIG. 8 is an exploded perspective view illustrating the portion of the image forming apparatus in FIG. 3.

Referring to FIGS. 3 and 7, the belt assembly 110 includes the transfer belt 111, a pair of a first belt roller 115 and a second belt roller 113 which drive the transfer belt 111 to circulate, side frames 116 and 117 which are disposed at lateral opposite sides of the transfer belt 111 along its circulating direction, and an elastic tension member 118 (FIG. 8).

The first belt roller 115 has a first roller shaft 115*b* and an elastic layer (not illustrated) surrounding an outer surface of the first roller shaft 115*b*. A first belt roller driving gear 115*a* is disposed at one end side portion of the first roller shaft 115*b*. The first belt roller driving gear 115*a* receives driving force from a belt driving motor (not illustrated) to drive the transfer belt 111.

The first roller shaft 115*b* is inserted into a position determining hole (not illustrated). The position determining hole (not illustrated) is formed at a transfer belt unit supporting frame (not illustrated) disposed stationarily in the image forming apparatus to determine an assembling position of the transfer belt unit.

The second belt roller 113 is disposed parallel with the first roller shaft 115*b* and provided so that it can slide to approach and depart from the first belt roller 115. The second belt roller 113 has a second roller shaft 113*b* being parallel with the first roller shaft 115*b*, and an elastic layer (not illustrated) surrounding an outer surface of the second roller shaft 113*b*.

The elastic tension member 118 applies elastic force to the second belt roller 113 so that the second belt roller 113 provided to move slidingly could depart from the first belt roller 115. Accordingly, the tension of the transfer belt 111 can be maintained to be in a predetermined range. Disposition and other conditions of the elastic tension member 118 will be described later.

A second belt roller transmission gear 113*a* is disposed at one end portion of the second roller shaft 113*b*. The second belt roller transmission gear 113*a* rotates successively when the transfer belt 111 circulates according to rotational drive of the first belt roller 115. The second belt roller transmission gear 113*a* is engaged with a transmission gear (135 in FIG. 11A) disposed in the cleaning housing 131.

The transmission gear 135 (135 FIG. 11A) is rotatably supported by the cleaning housing 131, and is engaged with a conveying unit gear 133*a* that is engaged with a rotating shaft of a waste developer conveying unit 133 that conveys the waste developer. Accordingly, the driving force transmitted to the first belt roller driving gear 115*a* is delivered through the transfer belt 111, the second belt roller 113 and the transmission gear 135 to drive the waste developer conveying unit 133.

The waste developer conveying unit 133 conveys the waste developer loaded in the cleaning housing 131 toward a waste developer discharging outlet (not illustrated) provided at one side of the cleaning housing 131.

If necessary, the second belt roller 113 instead of the first belt roller 115 may be driven. However, the first belt roller 115 having fixed position is driven in that a more simplified driving force transmitting structure can be obtained compared to driving the second roller shaft 113 which moves slidingly to maintain the tension of the transfer belt 111.

As illustrated in FIG. 3, the side frames 116 and 117 are disposed at both lateral sides of the first and the second roller shafts 115*b* and 113*b* respectively. As a pair of the side frames 116 and 117 are laterally symmetrical to each other, only the left side frame 116 will be described.

The side frame 116 has a first roller shaft inserting perforation 116*c* that the first roller shaft 115*a* is inserted through. Also, the side frame 116 has a position determining protrusion 116*b* that is inserted into another position determining hole (not illustrated) formed at the transfer belt unit supporting frame (not illustrated). That is, as each of the first roller shaft 115*b* and the position determining protrusion 116*b* is inserted into the position determining hole (not illustrated), the transfer belt unit 100 can be disposed within the image forming apparatus.

Figure 4:
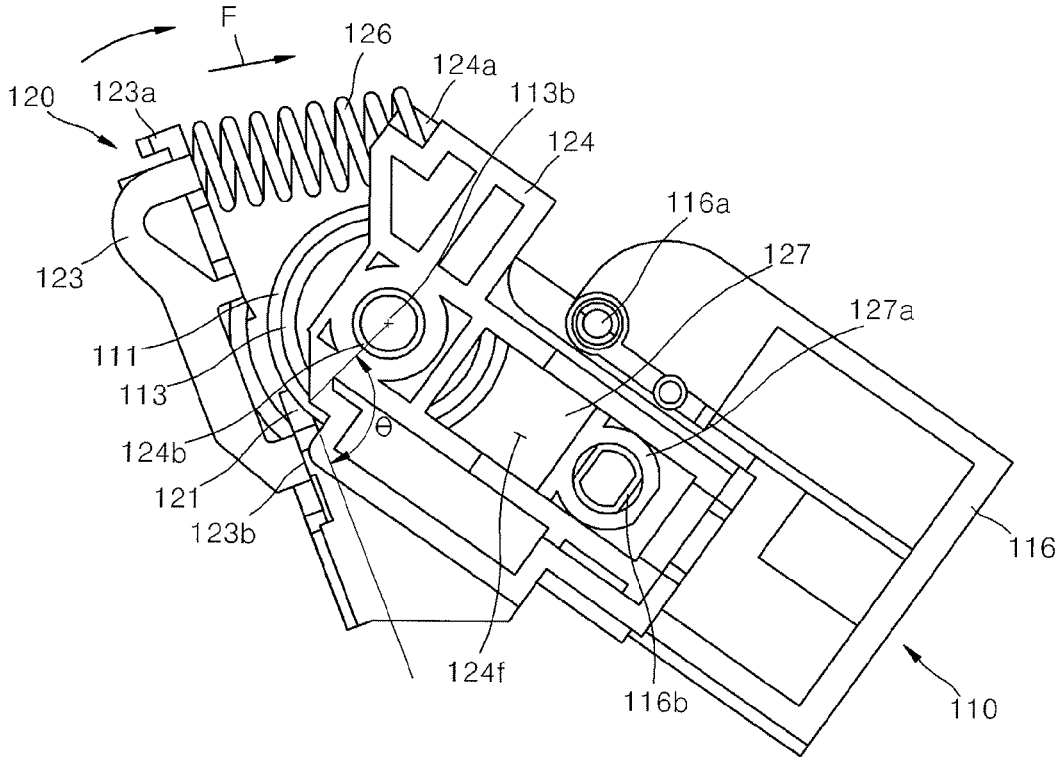
FIGS. 4 and 5 are schematic sectional views illustrating the portion of the image forming apparatus in FIG. 3.

Also, as illustrated in FIGS. 4 and 7, the side frame 116 has a combining hole. Through the combining hole are combined the cleaning housing 131 with the side frame 116.

Figure 5:
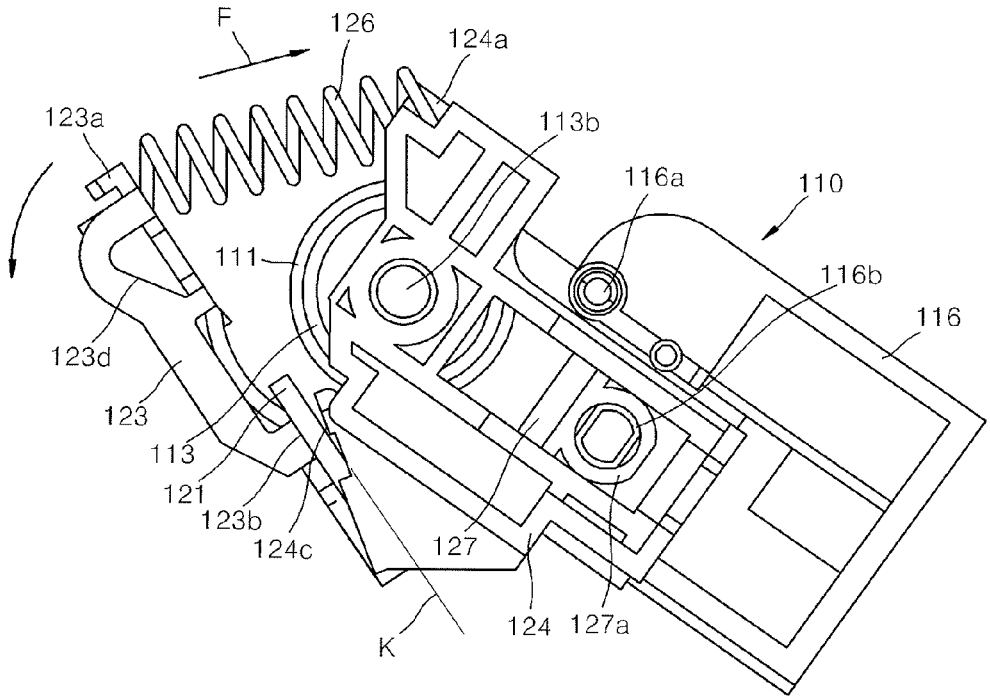

FIGS. 4 and 5 are schematic sectional views of a portion of the belt cleaning unit 120. FIG. 4 is a sectional view of the belt cleaning unit 120 when a blade 121 is in a cleaning position that contacts the transfer belt 111, and FIG. 5 is a sectional view of the belt cleaning unit 120 when the blade 121 is in a stand-by position that departs from the transfer belt 111.

As illustrated in FIGS. 3 to 5, the belt cleaning unit 120 includes the blade 121, a blade supporting member 123, a pair of slide members 124 and 125, a blade elastic member 126 and a pair of guiding members 127. As the pair of the slide members 124 and 125, and the pair of the guiding members 127 are laterally symmetrical like the side frames 116 and 117, only the left slide member 124 and the left guiding member 127 will be described.

The blade 121 is made of elastic material and is provided to move between a cleaning position that contacts and presses a surface of the transfer belt 111 with a predetermined pressure and a stand-by position that is departed from the surface of the transfer belt 111. Accordingly, if the transfer belt 111 needs cleaning, the blade 121 is moved to the cleaning position, so that the waste developer can be removed from the surface of the transfer belt 111.

Also, the blade 121 is supported by the blade supporting member 123 so that it can slide together with the second belt roller 113 when the second belt roller 113 slides.

Figure 6:
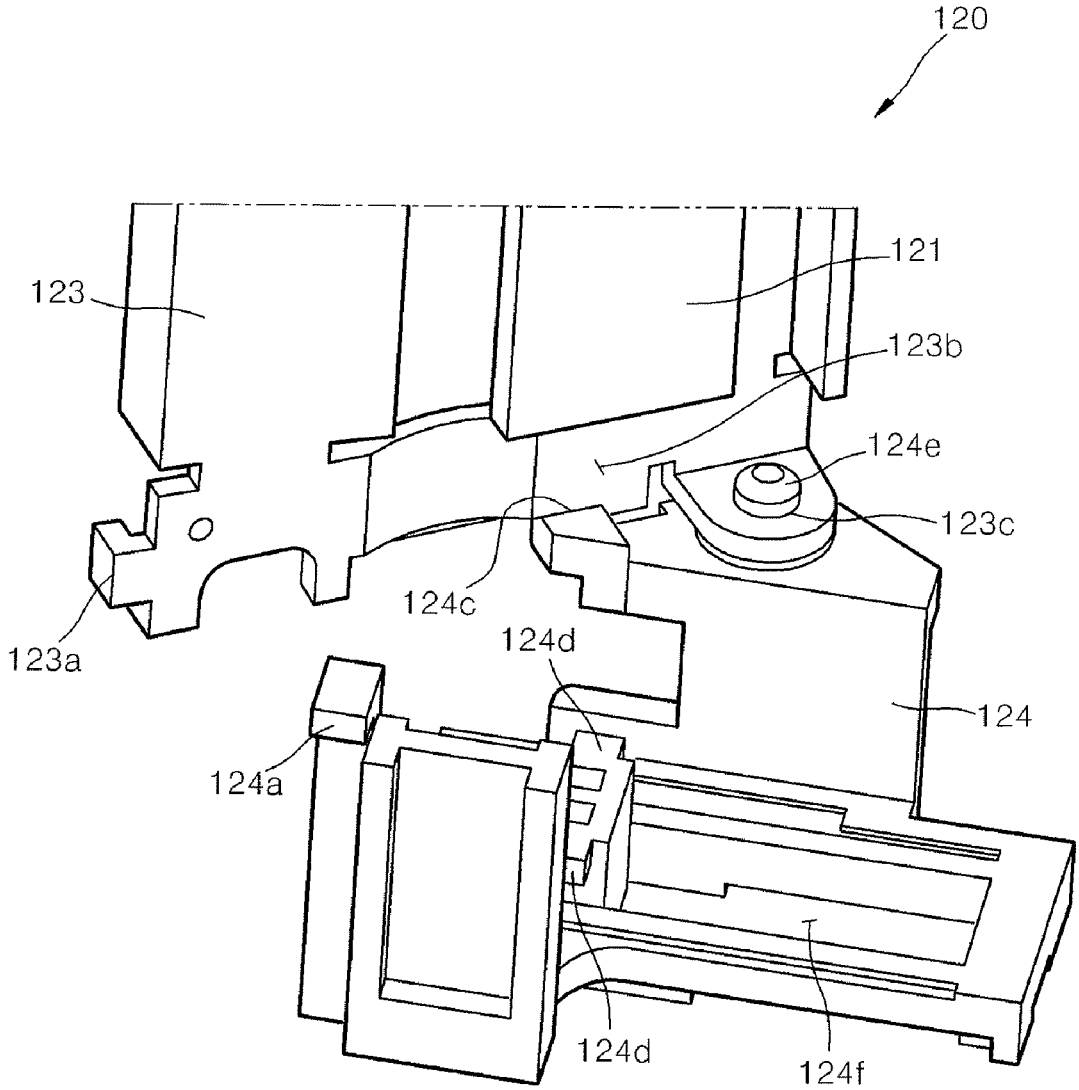
FIG. 6 is a perspective view illustrating a portion of a belt cleaning unit of the image forming apparatus in FIG. 3.

As illustrated in FIG. 6, the blade supporting member 123 has a slide member inserting hole 123*c* where a supporting member inserting protrusion 124*e* of the slide member 124 to be described is inserted. Accordingly, the blade supporting member 123 and the blade 121 can slide together with the second belt roller 113 as well as being rotatably supported about a blade rotating axis by the slide member 124. Accordingly, the blade rotating axis corresponds to a central axis of the supporting member inserting protrusion 124*e*.

Also, the blade supporting member 123 has an elastic member combining protrusion 123*a*. One end portion of the blade elastic member 126 is combined with the elastic member combining protrusion 123*a* of the blade supporting member 123. Also, the other end portion of the blade elastic member 126 is combined with an elastic member combining protrusion 124*a* of the slide member 124 to be described later.

The blade elastic member 126 applies elastic force F to the blade supporting member 123 to maintain the blade 121 at the cleaning position M. The blade elastic member 126 may be provided as a compression coil spring. The blade elastic member 126 may be provided as various configurations as long as it can apply the elastic force to the blade supporting member 123.

Also, the blade supporting member 123 has a stopper contacting portion 123*b* which contacts a stopper 124*c* of the slide member 124 to prevent over-rotation of the blade 121. Accordingly, as illustrated in FIG. 4, angle θ formed between a width direction of the blade 121 and a radial direction of the second belt roller 113 can be maintained to be substantially uniform so that the blade 121 presses the transfer belt 111 with a uniform contact pressure.

Also, as described above, a satisfactory cleaning performance can be obtained according to the blade supporting member 123. Especially, as the contact pressure can be maintained to be substantially uniform for a long period of time, problems in cleaning due to a time dependent deformation can be solved. Also, damage at a tip end portion of the blade 121 due to excessive contact pressure on the blade 121 can be prevented.

The slide member 124, as illustrated in FIGS. 4 and 5, has the elastic member combining protrusion 124*a*, a second roller shaft inserting hole 124*b*, the stopper 124*c*, a sliding guide protrusion 124*d* (FIG. 6), the supporting member inserting protrusion 124*e* and an elastic tension member accommodating hole 124*f*.

The second roller shaft 113*b* is inserted into the second roller shaft inserting hole 124*b*, and hence the slide member 124 rotatably supports the second roller shaft 113*b*. Accordingly, the slide member 124 and the second belt roller 113 can be moved together.

The stopper 124*c* performs a function of preventing the blade 121 from over-rotating beyond the cleaning position M. As illustrated in FIG. 6, the stopper 124*c* may be provided to contact the stopper contacting portion 123*b* of the blade supporting member 123.

Figure 12:
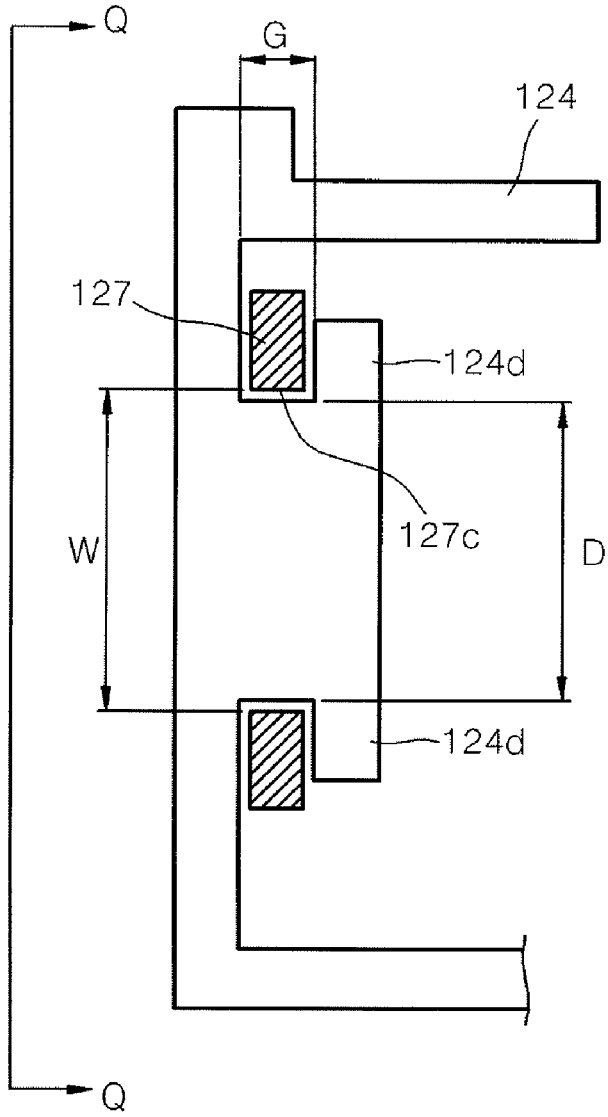
FIG. 12 is a schematic sectional view taken along XII-XII in FIG. 7.
Figure 14:
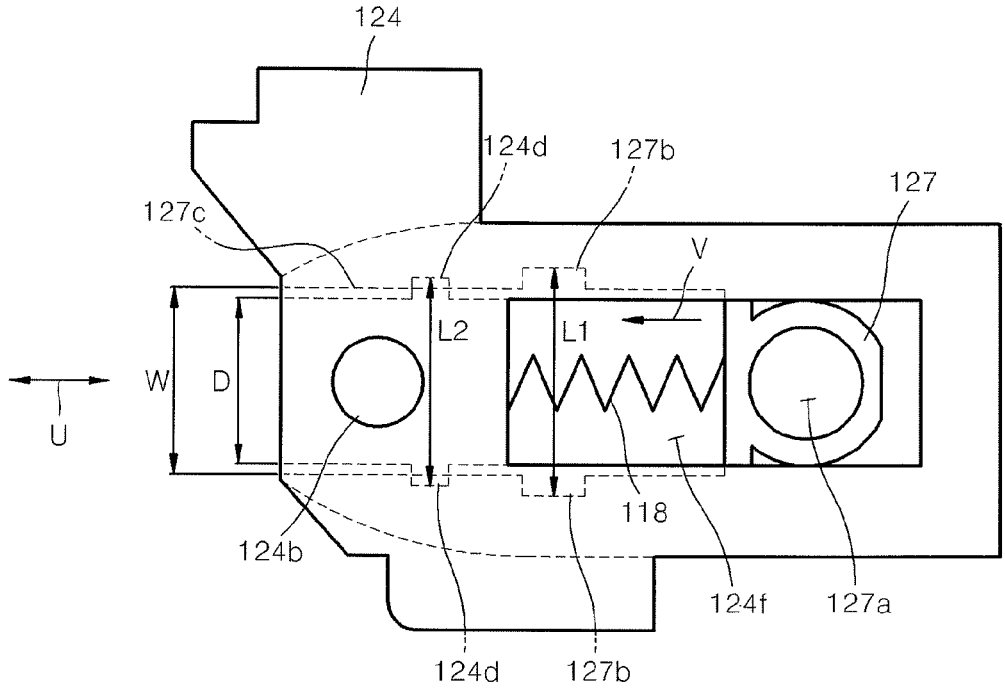
FIG. 14 is a plan view taken along Q-Q in FIG. 12.

The sliding guide protrusion 124*d*, as illustrated in FIGS. 6, 12 and 14, may be provided at upper and lower portions of an inside of the slide member 124 respectively with a space G corresponding to a thickness of the guiding member 127.

As illustrated in FIGS. 12 and 14, the guiding member 127 has a guiding protrusion perforation 127*b* that the sliding guide protrusion 124*d* can pass through. That is, distance L1 between the guiding protrusion perforations 127*b* is provided to be larger than a protruding height L2 of the sliding guide protrusion 124*d*. Also, width D between the sliding member protrusion is smaller than width W between sliding guide hollows 127*c* to be described later. Accordingly, the slide member 124 and the guiding member 127 can be combined to slide with each other by inserting the sliding guide protrusion 124*d* of the slide member 124 into the guide protrusion perforation 127*b* of the guiding member 127.

Figure 13:
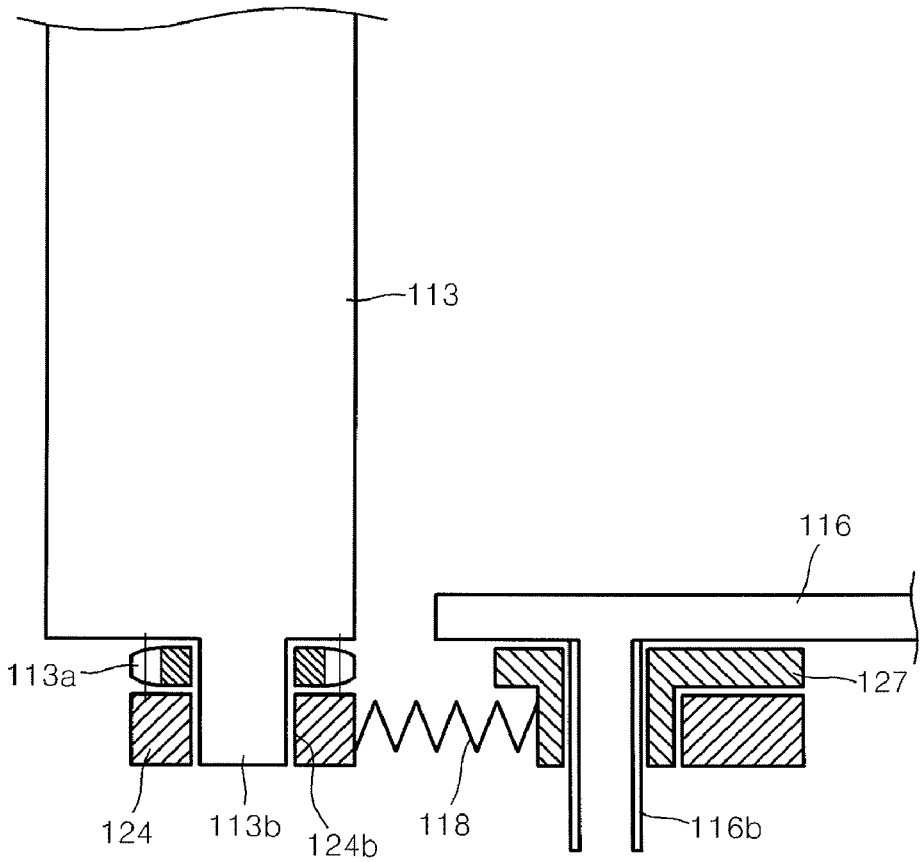
FIG. 13 is a schematic sectional view taken along XIII-XIII in FIG. 7.

The guiding member 127 is combined with the side frames 116 and 117 to be provided stationary within the image forming apparatus 100. As illustrated in FIGS. 4 and 13, the guiding member 127 has a position determining protrusion perforation 127*a* that the position determining protrusion 116*b* of the side frame 116 passes through.

Also, the guiding member 127 has the sliding guide hollow 127*c* having a predetermined width W and formed along a straight direction U. Accordingly, the slide member 124 can move slidingly along the sliding guide hollow 127*c* in the straight direction U. As the slide member 124 moves slidingly in the straight direction U, the second belt roller 113 and the blade supporting member 123 can move slidingly together with the slide member 124 so that the blade 121 presses the transfer belt 111 with a predetermined contact pressure. Therefore, the satisfactory cleaning performance can be obtained. Especially, as the contact pressure can be maintained to be relatively uniform for a long period of time, the problem of malfunction in cleaning due to deformation according to a progressing of time can be solved. Also, the damage at a tip end portion of the blade 121 due to excessive contact pressure on the blade 121 can be prevented.

The slide member 124 has the elastic tension member accommodating hole 124*f* that accommodates the elastic tension member 118. As illustrated in FIGS. 13 and 14, the elastic tension member 118 is provided between the slide member 124 and the guide member 127 within the elastic tension member accommodating hole 124*f*. Also, the elastic tension member 118 pushes the slide member 124 in direction V in which the second belt roller 113 departs from the first belt roller 115.

As illustrated in FIGS. 7, 13 and 14, the elastic tension member 118 may be provided as the compression coil spring, or may be provided as various configurations as long as it can push the slide member 124 in direction V to maintain the tension of the transfer belt 111 in a predetermined range.

Figure 11A:
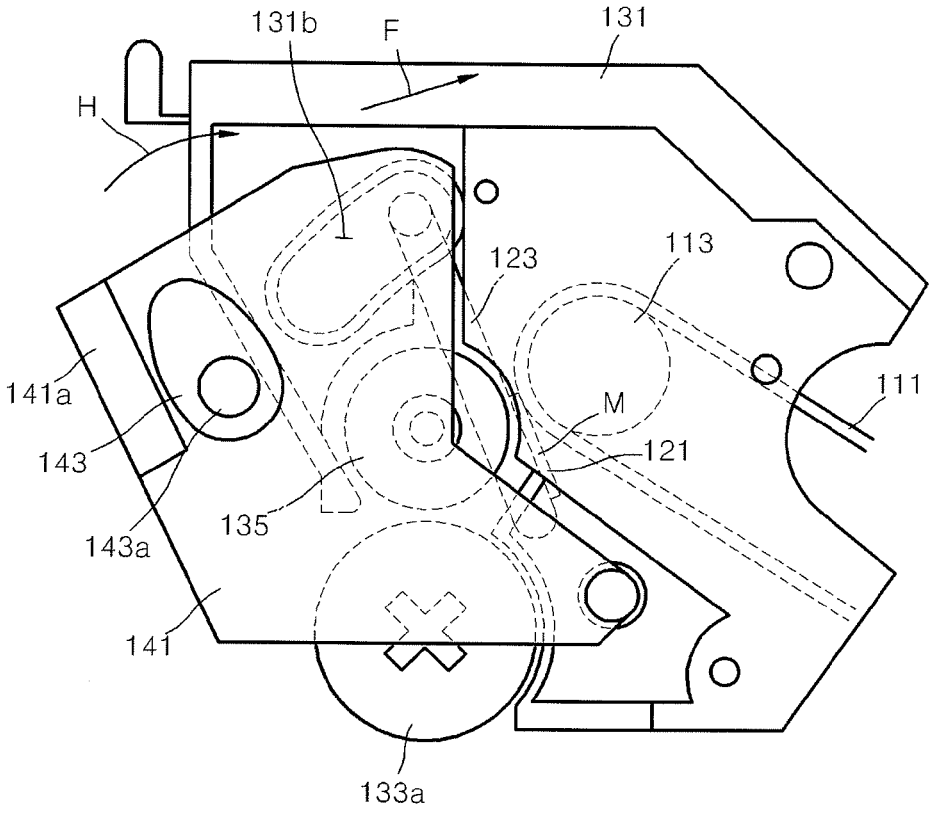
FIGS. 11A and 11B are schematic side views of the portion of the image forming apparatus of FIG. 3 to describe an operating process of the cleaning driving unit so that a blade may be in a cleaning position and a stand-by position respectively.

Accordingly, as illustrated in FIGS. 3 and 11A, the cleaning housing 131 has a waste developer storing unit 131*d*, a combining hole 131*a*, a protrusion perforation 131*b* where a supporting member connected rotating protrusion (141*c* in FIG. 8) of the lever 141 to be described later is inserted, and a hinge hole 131*c* where a rotating center protrusion (141*b* in FIG. 8) of the lever 141 is inserted. An upper side of the cleaning housing 131 is covered by a cover 157.

As illustrated in FIG. 11A, the protrusion perforation 131*b* is provided as an elongated hole of an arc shape having its center at the hinge hole 131*c* in consideration of a rotation angle of the lever 141.

The cleaning driving unit 140 selectively moves the blade 121 of the belt cleaning unit 120 to the cleaning position M and the stand-by position K. The cleaning driving unit 140 may be provided as various configurations as long as it performs the functions as described above. For example, the cleaning driving unit 140 may be provided as a driving motor that directly drives the blade supporting member 123 to rotate.

The cleaning driving unit 140, as illustrated in FIGS. 3 and 11A, may include the lever 141, a cam 143 and a cam driving unit (not illustrated) driving the cam 143 to rotate.

As illustrated in FIG. 8, the lever 141 has a cam contact protrusion 141*a*, the rotating center protrusion 141*b* and the supporting member connected rotating protrusion 141*c*. The cam contact protrusion 141*a* is protruded toward the cam 143 so that it can be selectively contacted by the cam 143.

Referring to FIGS. 8 and 11A, the rotating center protrusion 141*b* is the rotating center of the lever 141. The supporting member connected rotating protrusion 141*c* passes through the protrusion perforation 131*b* (FIG. 11A) of the cleaning housing 131 to be inserted through a lever protrusion inserting hole 123*d* of the supporting member 123. Accordingly, as the lever 141 rotates, the blade supporting member 123 also rotates in the same rotating direction of the lever 141.

The cam driving unit (not illustrated) may be an electrical motor. If required, the cam driving unit (not illustrated) may include a handle (not illustrated) which is exposed to an outside of the image forming apparatus. The handle (not illustrated) may be provided to be moved between a first position where it makes the blade 121 be at the cleaning position and a second position where it makes the blade 121 be at the stand-by position. Accordingly, a user can manually operate the handle to selectively clean the transfer belt 111.

Figure 11B:
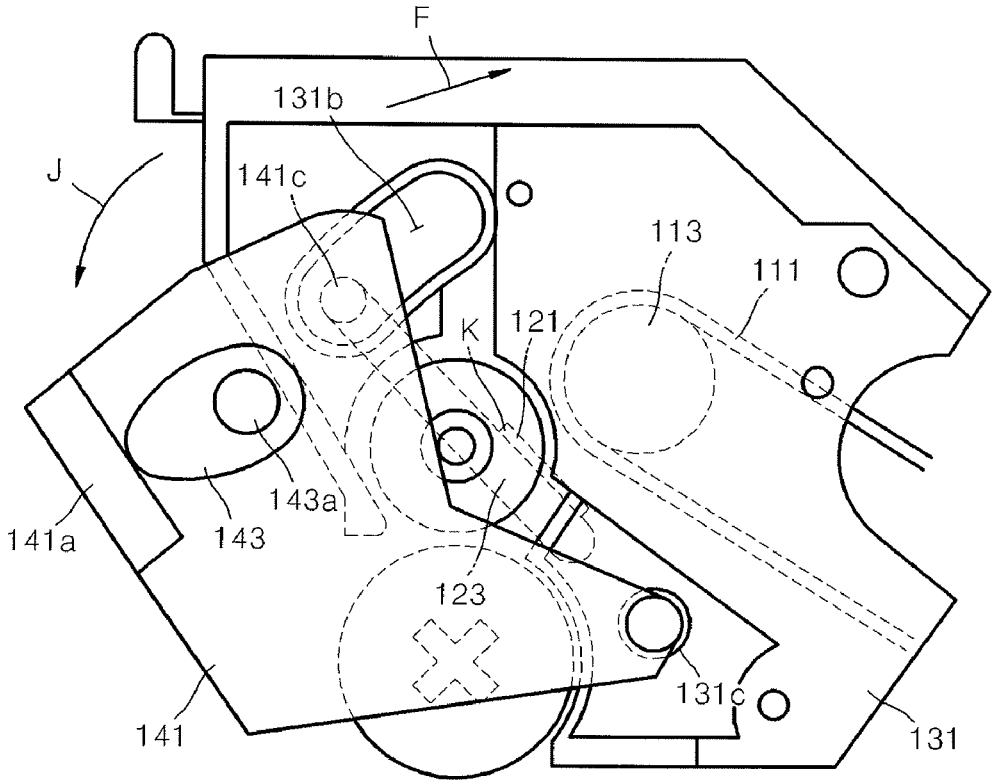

FIGS. 11A and 11B are schematic side views illustrating a portion of the transfer belt unit in states that the cam 143 releases and applies pressure on the lever 141 respectively.

The cam 143, as illustrated in FIGS. 11A and 11B, selectively contacts or departs from the cam contact protrusion 141*a* of the lever 141 to apply or release pressure on the lever 141. In FIG. 11A, the cam 143 does not contact the cam contact protrusion 141*a*, so that the blade supporting member 123 rotates clockwise H around the supporting member inserting protrusion 124*e* (FIG. 6) of the slide member 124. Accordingly, the lever 141 rotating in connection with the blade supporting member 123 also rotates clockwise H around the hinge hole 131*c*. Therefore, the blade supporting member 123 rotates clockwise H by restoring force F of the blade elastic member (126 in FIG. 4) described above. However, the over-rotation of the blade supporting member 123 is prevented by the stopper 124*c* formed at the slide member 124, so that the blade 121 can be stably located at the cleaning position M.

As illustrated in FIG. 11B, if the cam 143 contacts the cam contact protrusion 141*a* to rotate the lever 141 counterclockwise J, the blade supporting member 123 also rotates counterclockwise J in connection with the lever 141. Accordingly, the blade 121 departs from surface of the transfer belt 111 to move to the stand-by position K.

The cam driving unit (not illustrated) drives the cam 143 around a cam shaft 143*a* and may be provided as a conventional electric motor.

Figure 9:
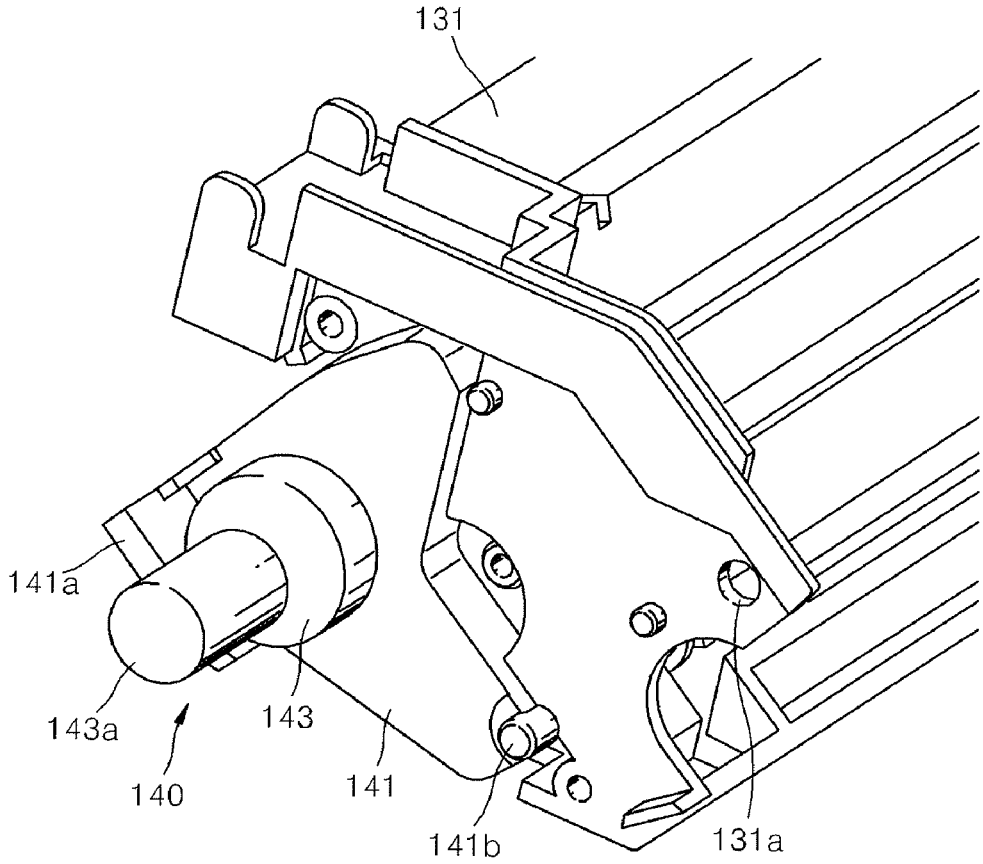
FIG. 9 is a lateral perspective view illustrating the portion of the image forming apparatus in FIG. 3 in a state that a cleaning driving unit is disposed in a cleaning housing.
Figure 10:
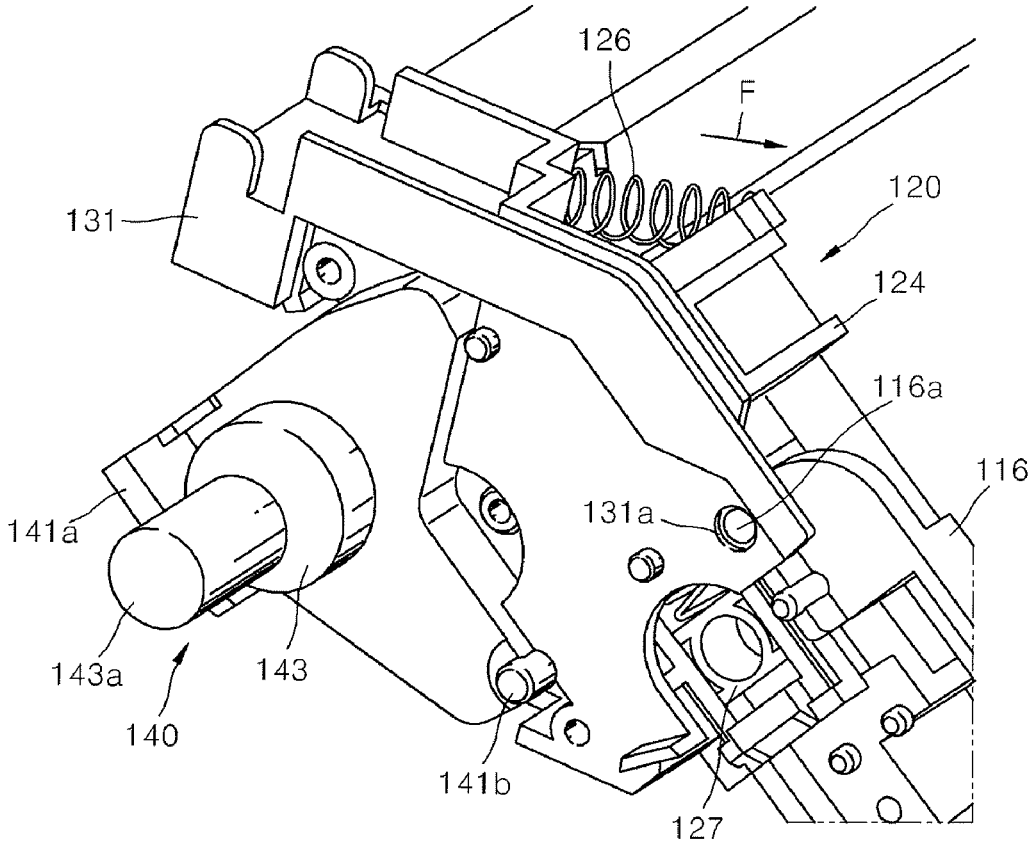
FIG. 10 is a lateral perspective view illustrating the portion of the image forming apparatus in FIG. 3 in a state that the cleaning driving unit and the belt cleaning unit are assembled.

FIGS. 9 and 10 are left side perspective views illustrating the transfer belt unit. Assembling process of the transfer belt unit 100 will be described with reference to FIGS. 8 to 10. As the assembling process can be easily known by assembling a relationship among each component described in this specification, a brief description of it will be made.

The lever 141 is disposed in the cleaning housing 131. The supporting member connected rotating protrusion 141*c* and the rotating center protrusion 141*b* of the lever 141 are inserted into the protrusion perforation (131*b* in FIG. 11A) and the hinge hole (131*c* in FIG. 11A) of the cleaning housing 131.

The belt assembly (110 in FIG. 4) and the belt cleaning unit (120 in FIG. 4) are assembled independently. Then, the second roller shaft (113*b* in FIG. 4) and the position determining protrusion (116*b* in FIG. 4) of the assembled belt assembly (110 in FIG. 4) are inserted into the second roller shaft inserting hole (124*b* in FIG. 4) and the position determining protrusion perforation (127*a* in FIG. 4) of the cleaning unit (120 in FIG. 4). Therefore, the belt assembly (110 in FIG. 4) and the belt cleaning unit (120 in FIG. 4) can be assembled together.

As illustrated in FIG. 10, a sub-assembly where the belt assembly 110 and the belt cleaning unit 120 are assembled together is combined with the lever 141 disposed in the cleaning housing 131. The supporting member connected rotating protrusion 141*c* of the lever 141 is inserted into the lever protrusion inserting hole 123*d* of the blade supporting member 123.

As illustrated in FIG. 3, the left side bracket 155 described above is disposed so that its combining hole 155*a* can correspond to a combining hole 116*a* and the combining hole 131*a*. The side frame 116, the cleaning housing 131 and the left side bracket (155 in FIG. 3) are combined together through the combining holes 116*a*, 131*a* and 155*a* by, for example, a fastener such as a bolt. Accordingly, the cleaning housing 131 is stationarily supported by the side frames 116 and 117. Therefore, the side frames 116 and 117 perform as a housing supporting frame that stationarily supports the cleaning housing. Also, the lever 141 can be prevented from being departed from the lever protrusion inserting hole 123*d* of the blade supporting member 123 by the left side bracket (153 in FIG. 3).

Also, the cam 143 is disposed at an outer side of the left side bracket (153 in FIG. 3) so that it can press the cam contact protrusion 141*a* of the lever 141. According to the above process, assembling the transfer belt unit can be completed.

The image forming apparatus according to the exemplary embodiment of the present general inventive concept may further include a controller (not illustrated) that controls the cleaning driving unit (140 in FIG. 11A) to selectively locate the blade (121 in FIG. 11A) at the cleaning position (M in FIG. 11A) and the stand-by position (K in FIG. 11B).

The controller (not illustrated) determines whether the transfer belt (111 in FIG. 11A) needs cleaning or not. The controller (not illustrated) may determine that the transfer belt 111 needs cleaning if there is user's request. Printing records such as an accumulated number of printed sheets or printing time may be stored and used to determine whether the transfer belt needs cleaning by comparing the printing record with a predetermined basis.

The controller (not illustrated) controls the cleaning driving unit to locate the blade (121 in FIG. 11A), at the cleaning position (M in FIG. 11A), if the cleaning is required and, at the stand-by position (K in FIG. 11B), if the cleaning is not required.

Especially, where the cleaning driving unit 150 having the cam 143 and the lever 141 as described in FIG. 11A, the controller (not illustrated) controls the cam driving unit (not illustrated) to locate the cam 143 at a position to release its pressure from the lever 141 if the transfer belt (111 in FIG. 11A) needs cleaning as illustrated in FIG. 11A. The controller (not illustrated) controls the cam driving unit (not illustrated) to locate the blade 121 at the stand-by position K through pressing the lever 141 by the cam 123 if the transfer belt (111 in FIG. 11A) doesn't need cleaning. Therefore, the blade 121 and the transfer belt 111 are made to be separated apart from each other if the cleaning is unnecessary, thus decreasing abrasion of the blade 121 and the transfer belt 111. Accordingly, lifetime and durability of the corresponding components can be improved.

The present general inventive concept can also be embodied as computer-readable codes on a computer-readable medium. The computer-readable medium can include a computer-readable recording medium and a computer-readable transmission medium. The computer-readable recording medium is any data storage device that can store data that can be thereafter read by a computer system. Examples of the computer-readable recording medium include read-only memory (ROM), random-access memory (RAM), CD-ROMs, magnetic tapes, floppy disks, and optical data storage devices. The computer-readable recording medium can also be distributed over network coupled computer systems so that the computer-readable code is stored and executed in a distributed fashion. The computer-readable transmission medium can transmit carrier waves or signals (e.g., wired or wireless data transmission through the Internet). Also, functional programs, codes, and code segments to accomplish the present general inventive concept can be easily construed by programmers skilled in the art to which the present general inventive concept pertains.

Hereinbefore, cleaning the transfer belt 111 has been described as the exemplary embodiment of the present general inventive concept. However, the present general inventive concept may also be applied to any circulating belt other than the transfer belt 111 that needs cleaning due to the remaining developer thereon. Such a belt may be a paper transfer belt, a photosensitive belt or other belts known in the art.

Also, the blade has been described to rotate between the cleaning position and the stand-by position. However, if required, the blade 121 may be provided not to rotate but to slide.

The image forming apparatus and the belt cleaning unit according to the present general inventive concept can provide the following effects.

Firstly, even if the belt roller slides to maintain belt tension, the blade moves together with the belt roller, so that the blade can press the belt with a uniform contact pressure. Accordingly, the waste toner remaining on the belt can be effectively removed. Also, the damage of the blade can be prevented due to an excessive contact pressure thereon.

Secondly, if the belt cleaning is unnecessary, the blade can be moved to the stand-by position, so that the life time and the durability of the belt and the blade can be improved.

Although various exemplary embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus, comprising:
- a first belt roller which has a first rover shaft;
- a second belt roller which is disposed parallel with the first roller shaft and slidingly approaches and departs from the first roller shaft, and has a second roller shaft;
- a belt which is driven in circulation by the first belt roller and the second belt roller;
- an elastic tension member which elastically pushes the second belt roller to be separated from the first belt roller; and
- a belt cleaning unit which is movable between a cleaning position contacting a surface of the belt and a stand-by position departed from the surface of the belt, wherein the belt cleaning unit includes:
  - a blade which is enabled to contact the surface of the belt;
  - a blade supporting member which supports the blade;
  - a slide member which rotatably supports the blade supporting member about a blade rotating axis being parallel with the second roller shaft and is able to slide along with the second roller shaft; and
  - a blade elastic member which connects the blade supporting member and the slide member to apply elastic force to the blade supporting member to be rotated to the cleaning position.

2. The image forming apparatus according to claim 1, wherein the belt cleaning unit is supported by the second roller shaft.

3. The image forming apparatus according to claim 1, wherein the belt cleaning unit further comprises:
- a stopper which is provided at the cleaning position and regulates a rotating position of the blade supporting member.

4. The image forming apparatus according to claim 3, wherein the blade elastic member connects the slide member with the blade supporting member.

5. The image forming apparatus according to claim 3, further comprising:
- a cleaning driving unit which selectively moves the blade to the cleaning position and the standby position.

6. The image forming apparatus according to claim 5, further comprising:
- a controller which controls the cleaning driving unit for the blade to be located at the standby position if the belt doesn't need cleaning.

7. The image forming apparatus according to claim 3, wherein the stopper is provided integrally with the slide member.

8. The image forming apparatus according to claim 7, wherein the blade elastic member connects the slide member with the blade supporting member.

9. The image forming apparatus according to claim 1, further comprising:
- a cleaning driving unit which selectively moves the blade to the cleaning position and the stand-by position.

10. The image forming apparatus according to claim 9, wherein the cleaning driving unit comprises:
- a lever which rotates in connection with the blade supporting member;
- a cam which applies or releases pressure on the lever so that the blade can move to the stand-by position or to the cleaning position; and
- a cam driving unit which drives the cam to rotate.

11. The image forming apparatus according to claim 10, further comprising:

a controller which determines whether the belt needs cleaning and controls the cam driving unit on a basis of the determination.

12. The image forming apparatus according to claim 10, further comprising:

a cleaning housing which accommodates the blade and the blade supporting member and rotatably supports the lever; and a housing supporting frame which stationarily supports the cleaning housing.

13. The image forming apparatus according to claim 1, further comprising:

a photosensitive body which is developed with developer so that a developer visualized image corresponding to image information can be formed; and a transfer roller which is disposed parallel with the photosensitive member by having the belt therebetween.

14. The image forming apparatus according to claim 1, wherein the blade is located between the blade rotating axis and the blade elastic member.

15. The image forming apparatus according to claim 1, wherein at least a portion of the blade support member is configured to rotate away from the slide member via the blade rotating axis.

16. A belt cleaning unit to remove developer remaining on a surface of a belt in an image forming apparatus, comprising:

a first belt roller which has a first roller shaft;

a second belt roller which is disposed parallel with the first roller shaft and slidingly approaches and departs from the first roller shaft and has a second roller shaft;

the belt which is driven in circulation by the first belt roller and the second belt roller;

an elastic tension member which elastically pushes the second belt roller to be separated from the first belt roller; and a blade which is movable between a cleaning position contacting with the surface of the belt and a stand-by position departing from the surface of the belt;

a blade supporting member which supports the blade; and a slide member which rotatably supports the blade supporting member about a blade rotating axis being parallel with the second roller shaft and is able to slide along with the second roller shaft; and a blade elastic member which connects the blade supporting member and the slide member to apply elastic force to the blade supporting member to be rotated to the cleaning position.

17. The belt cleaning unit according to claim 16, wherein the blade is supported by the second roller shaft.

18. The belt cleaning unit according to claim 16, further comprising:

a stopper which is provided at the cleaning position and regulates a rotating position of the blade supporting member.

19. The belt cleaning unit according to claim 16, further comprising:

a lever which rotates in connection with the blade supporting member;

a cam which applies or releases pressure on the lever so that the blade can move to the standby position or to the cleaning position; and a cam driving unit which drives the cam to rotate.

20. The belt cleaning unit according to claim 19, further comprising:

a controller which controls the cam driving unit for the cam to release pressure from the lever if the belt doesn't need cleaning.

21. An image forming apparatus, comprising:

a belt to receive developer;

a roller disposed proximate to the belt to move in a tension-adjusting direction to change an amount of tension of the belt and having a roller shaft; and a belt cleaning unit to contact the belt at a contact area to remove unused developer from the belt and to move corresponding to the movement of the roller to substantially remain in contact with the belt at the contact area, wherein the belt cleaning unit includes:

a blade which is enabled to contact the surface of the belt;

a blade supporting member which supports the blade;

a slide member which rotatably supports the blade supporting member about a blade rotating axis being parallel with the roller shaft and is able to slide along with the roller shaft; and a blade elastic member which connects the blade supporting member and the slide member to apply elastic force to the blade supporting member to be rotated to the cleaning position.

22. The image forming apparatus of claim 21, wherein an angle formed between a width direction of the blade and a radial direction of the roller is maintained substantially uniform and contact pressure of the blade and the belt is substantially uniform.

23. An image forming apparatus, comprising:

a belt to receive developer;

a roller disposed proximate to the belt to move in a tension-adjusting direction to change an amount of tension of the belt and having a roller shaft; and a belt cleaning unit supported by the roller to move between a cleaning position contacting a surface of the belt to remove unused developer from the belt and a stand-by position not in contact with the surface of the belt, and wherein the belt cleaning unit includes a blade which is enabled to contact the surface of the belt;

a blade supporting member which supports the blade;

a slide member which rotatably supports the blade supporting member about a blade rotating axis being parallel with the roller shaft and is able to slide along with the roller shaft; and a blade elastic member which connects the blade supporting member and the slide member to apply elastic force to the blade supporting member to be rotated to the cleaning position.

* * * * *